US011642897B2

(12) United States Patent
Park et al.

(10) Patent No.: US 11,642,897 B2
(45) Date of Patent: May 9, 2023

(54) PRINTER WITH VERTICALLY EXTENDED PRINTING PATH

(71) Applicant: HEWLETT-PACKARD DEVELOPMENT COMPANY, L.P., Spring, TX (US)

(72) Inventors: Sungjin Park, Suwon (KR); Jeonghun Jang, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 456 days.

(21) Appl. No.: 17/045,913

(22) PCT Filed: Apr. 4, 2019

(86) PCT No.: PCT/US2019/025818
§ 371 (c)(1),
(2) Date: Oct. 7, 2020

(87) PCT Pub. No.: WO2019/199576
PCT Pub. Date: Oct. 17, 2019

(65) Prior Publication Data

US 2021/0170764 A1 Jun. 10, 2021

(30) Foreign Application Priority Data

Apr. 11, 2018 (KR) ..... 10-2018-0042424

(51) Int. Cl.
*B41J 29/00* (2006.01)
*B41J 3/36* (2006.01)
(Continued)

(52) U.S. Cl.
CPC ..... *B41J 3/445* (2013.01); *B41J 3/36* (2013.01); *B41J 29/06* (2013.01)

(58) Field of Classification Search
CPC ... B41J 29/00; B41J 29/02; B41J 29/06; B41J 29/08; B41J 3/445; B41J 3/36
See application file for complete search history.

(56) References Cited

U.S. PATENT DOCUMENTS 4,828,416 A * 5/1989 Pensavecchia ..... B41J 3/36 D18/50
5,443,320 A 8/1995 Agata
(Continued)

FOREIGN PATENT DOCUMENTS

| | | |
|---|---|---|
| JP | 2001-130090 | 5/2001 |
| KR | 100644609 | 11/2006 |
| RU | 2354070 C2 | 4/2009 |

*Primary Examiner* — Scott A Richmond
(74) *Attorney, Agent, or Firm* — Brooks, Cameron & Huebsch, PLLC

(57) ABSTRACT

A printer includes a vertical type main body accommodating a printing portion that prints an image onto a print medium transported along a vertically oriented printing path, including an outlet through which the print medium is discharged. A depth of the main body may be less than a width and a height of the main body. The printer may further include a stand supporting the main body such that the main body is rotatable forward and backward, a discharge guide mounted to the main body to be rotatable in a vertical direction and guiding the print medium discharged from the outlet forward, and an elastic member applying an elastic force to the discharge guide in a direction in which the discharge guide is rotated upward.

15 Claims, 10 Drawing Sheets

(51) Int. Cl.
*B41J 3/44* (2006.01)
*B41J 29/06* (2006.01)

(56) References Cited

U.S. PATENT DOCUMENTS

| | | | | |
|---|---|---|---|---|
| 5,813,780 | A * | 9/1998 | Kiyohara | B41J 13/076 400/633.2 |
| 6,382,851 | B2 | 5/2002 | Fujiwara | |
| 6,474,882 | B1 | 11/2002 | Vaghi | |
| 7,040,823 | B2 | 5/2006 | Silverbrook | |
| 2003/0160853 | A1 * | 8/2003 | Fetherolf | B41J 29/02 347/105 |
| 2013/0027497 | A1 | 1/2013 | Terrill et al. | |

* cited by examiner

PRINTER WITH VERTICALLY EXTENDED PRINTING PATH

CROSS REFERENCE TO RELATED APPLICATIONS

This application is filed under 35 U.S.C. 0.371 as a National Stage of PCT International Application No. PCT/US2019/025818, filed on Apr. 4, 2019, in the U.S. Patent and Trademark Office, which claims the priority benefit of Korean Patent Application No. 10-2018-0042424, filed on Apr. 11, 2018, in the Korean Intellectual Property Office. The disclosures of PCT International Application No. PCT/US2019/025818 and Korean Patent Application No. 10-2018-0042424 are incorporated by reference herein in their entireties.

BACKGROUND

Monitors and printers are used while individually connected to hosts, for example, computers. Monitors are generally used on desks.

To secure accessibility, desktop printers may be put on desks and used. General desktop printers have footprints that are greater than the maximum printable size of paper. Therefore, since general desktop printers occupy large spaces on desks, it is not easy to put general desktop printers on desks. Since a large desk is needed to put both a desktop printer and a monitor on a desk, it may not be easy to efficiently use a given space for home or small office/home office (SOHO). Although a desktop printer may be used by putting it on a separate desk near a desk on which a monitor is put, accessibility to the printer may deteriorate in this case.

DETAILED DESCRIPTION

Figure 1:
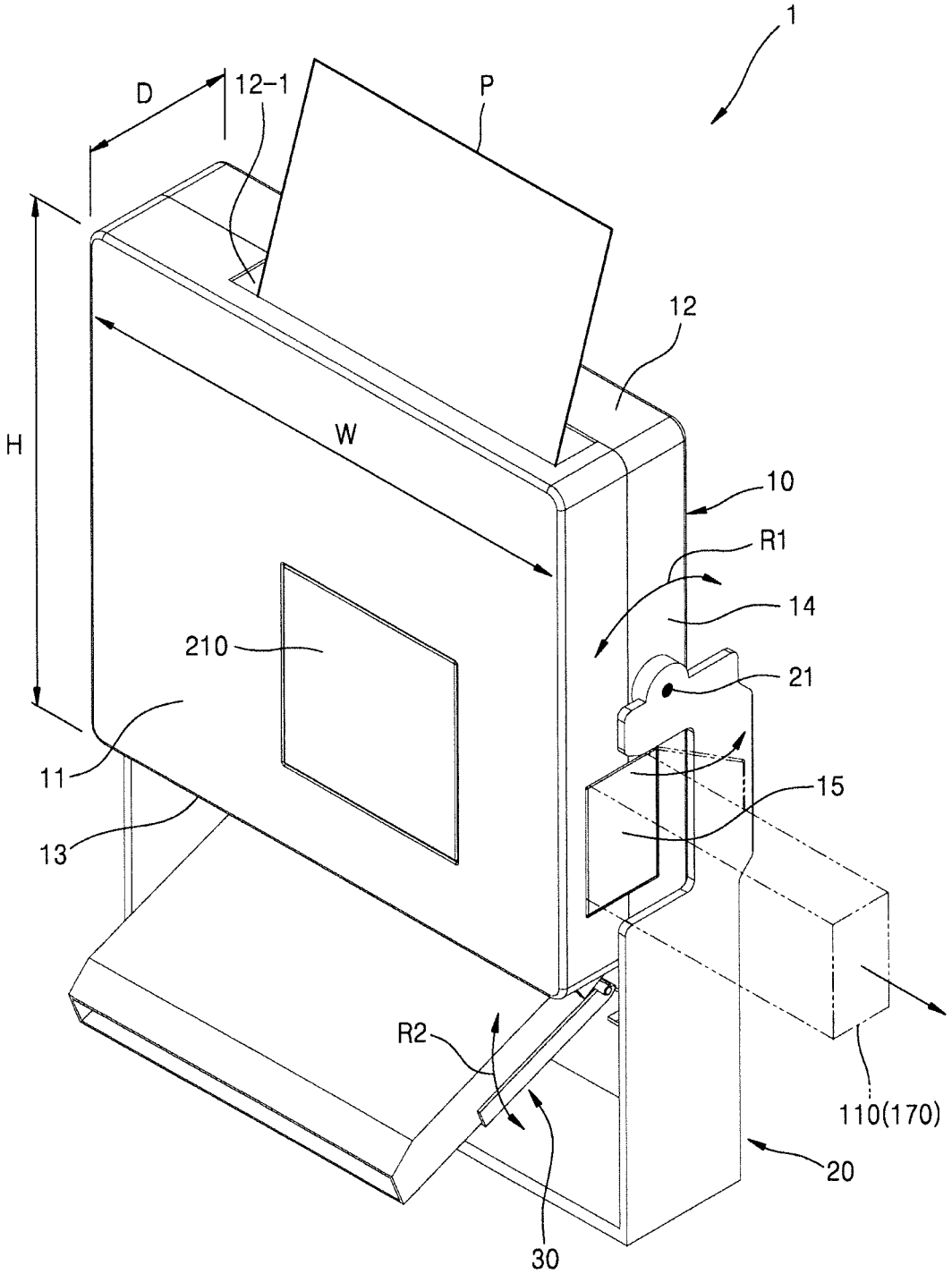
FIG. 1 is a perspective view of an example of a printer.
Figure 2:
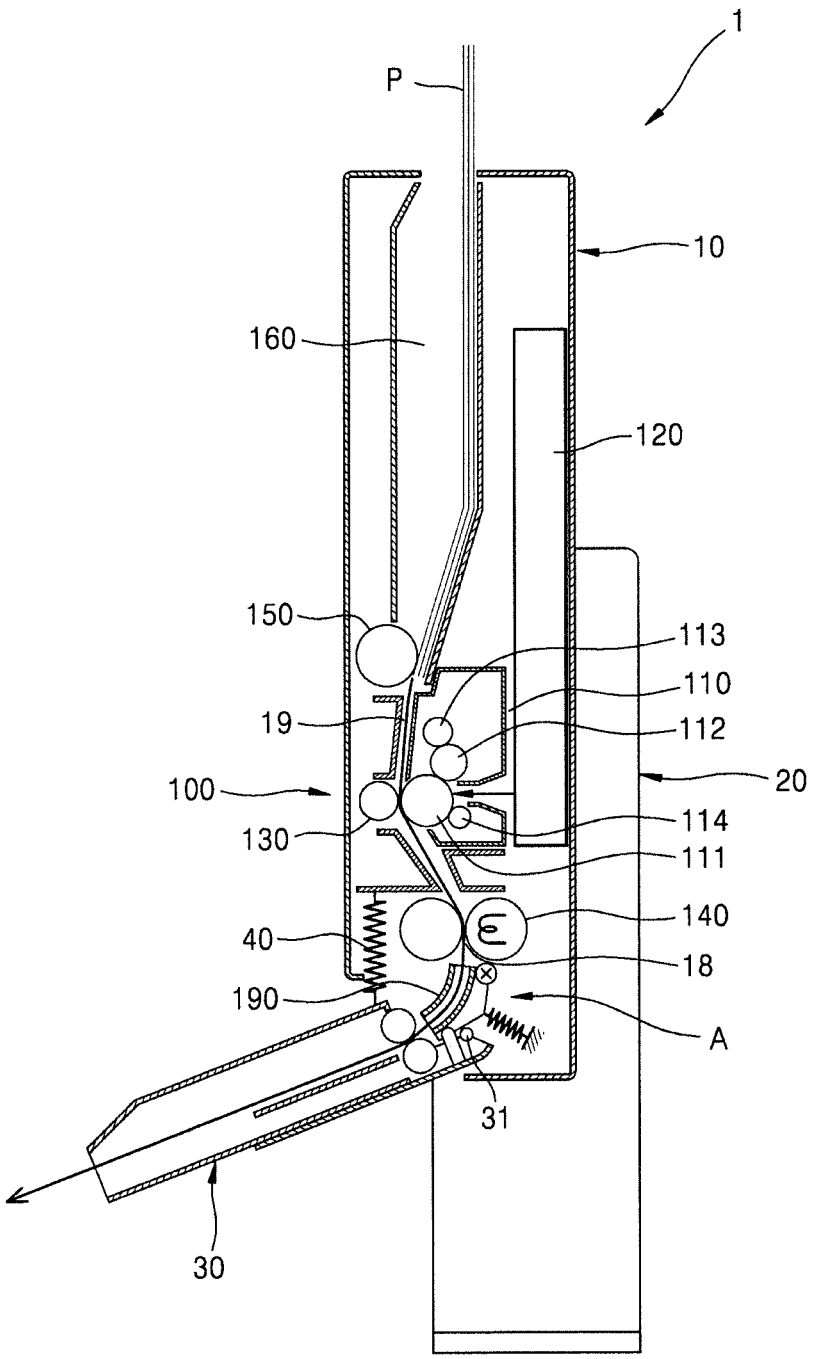
FIG. 2 is a longitudinal sectional view of the example of the printer shown in FIG. 1.

FIG. 1 is a perspective view of an example of a printer. FIG. 2 is a longitudinal sectional view of the example of the printer shown in FIG. 1. Referring to FIGS. 1 and 2, a printer 1 of the example is a vertical type printer. The printer 1 may include: a main body 10 accommodating a printing portion 100, which prints an image onto a print medium P, and including an outlet 18 through which the print medium P is discharged, the print medium P being transported along a vertically oriented printing path 19; a stand 20 supporting the main body 10 such that the main body 10 is rotatable in a front-rear direction R1; a discharge guide 30 mounted to the main body 10 to be rotatable in a vertical direction R2 and guiding the print medium P forward, the print medium P being discharged from the outlet 18; and a first elastic member 40 applying an elastic force to the discharge guide 30 in a direction in which the discharge guide 30 is rotated upward.

The print medium P is transported from an upper portion 12 to a lower portion 13 of the main body 10. For example, a feeding slot 12-1 through which the print medium P is fed may be provided to the upper portion 12 of the main body 10. The outlet 18 through which the printing-completed print medium P is discharged may be provided to the lower portion 13 of the main body 10. Although not shown in the drawings, the outlet 18 does not necessarily have to be provided to the lower portion 13 and may be provided to a lower region of a front portion 11 of the main body 10.

The printing portion 100 of the example prints the image onto the print medium P in an electrophotographic manner. The printing portion 100 may include a developing device 110 (development cartridge) that is replaceable, an exposure device 120, a transfer unit 130, and a fuser 140. The developing device 110 includes a photosensitive drum 111 and develops an electrostatic latent image into a visual toner image by supplying a toner accommodated inside the developing device 110 to the electrostatic latent image formed on the photosensitive drum 111.

The photosensitive drum 111 is an example of a photoconductor having an electrostatic latent image formed on a surface thereof, and may include a conductive metal pipe and a photosensitive layer on an outer circumference of the conductive metal pipe. The developing device 110 may include a developing roller 112. The developing roller 112 supplies the toner inside the developing device 110 to the photosensitive drum 111. A developing bias voltage may be applied to the developing roller 112. A regulating member, which is not shown, regulates, an amount of the toner supplied by the developing roller 112 to a development region in which the photosensitive drum 111 and the developing roller 112 face each other. The developing device 110 of the example employs a one-component developing manner. The developing roller 112 may be rotated in contact with the photosensitive drum 111. The developing roller 112 may be rotated while located apart from the photosensitive drum 111 by tens to hundreds of micrometers. The developing device 110 may include a supplying roller 113 attaching the toner onto a surface of the developing roller 112. A supply bias voltage may be applied to the supplying roller 113. The developing device 110 may include an agitator (not shown). The agitator may triboelectrically charge the toner inside the developing device 110 by agitating the toner. The agitator may transport the toner toward the supplying roller 113. A charging roller 114 is an example of a charger charging the photosensitive drum 111 such that the photosensitive drum 111 has a uniform surface electric potential. A charging brush, a corona charger, or the like may be used instead of the charging roller 114. Although not shown in the drawings, the developing device 110 may include a cleaning member removing foreign substances remaining on the surface of the photosensitive drum 111 after a transfer process.

The developing device 110 is a consumable that is replaced when the toner accommodated inside the developing device 110 is exhausted. The developing device 110 may be provided in the form of a development cartridge including the components described above.

The exposure device 120 forms the electrostatic latent image on the photosensitive drum 111 by irradiating the photosensitive drum 111 with light modulated in correspondence with image information. As the exposure device 120, a laser scanning unit (LSU) using a laser diode as a light source, a light emitting diode (LED) exposure device using an LED as a light source, or the like may be used.

The transfer unit 130 transfers the toner image formed on the photosensitive drum 111 onto the print medium P. For example, the transfer unit 130 may include a transfer roller that is rotated while facing the photosensitive drum 111. A transfer bias voltage for transferring the toner image onto the print medium P is applied to the transfer roller. A corona transfer unit or a pin scorotron type transfer unit may be used instead of the transfer roller.

The fuser 140 applies heat and pressure to the toner image transferred onto the print medium P, thereby fusing the toner image on the print medium P. As an example, the fuser 140 may include a heating roller and a pressing roller, which are rotated while engaged with each other to form a fusing nip. The heating roller may be heated by a heat source.

According to the configuration described above, the exposure device 120 forms the electrostatic latent image by scanning the light modulated in correspondence with the image information onto the photosensitive drum 111. The developing device 110 forms the visual toner image on the surface of the photosensitive drum 111 by supplying the toner onto the electrostatic latent image formed on the photosensitive drum 111. The print medium P loaded in a loading portion 160 is fed, one by one, to the vertically extending printing path 19. The toner image maintained on the photosensitive drum 111 due to an electrostatic force is transferred onto the print medium P by the transfer unit 130. When the print medium P passes through the fuser 140, the toner image is fused on the print medium P by heat and pressure. The fusing-completed print medium P is discharged through the outlet 18.

Figure 3:
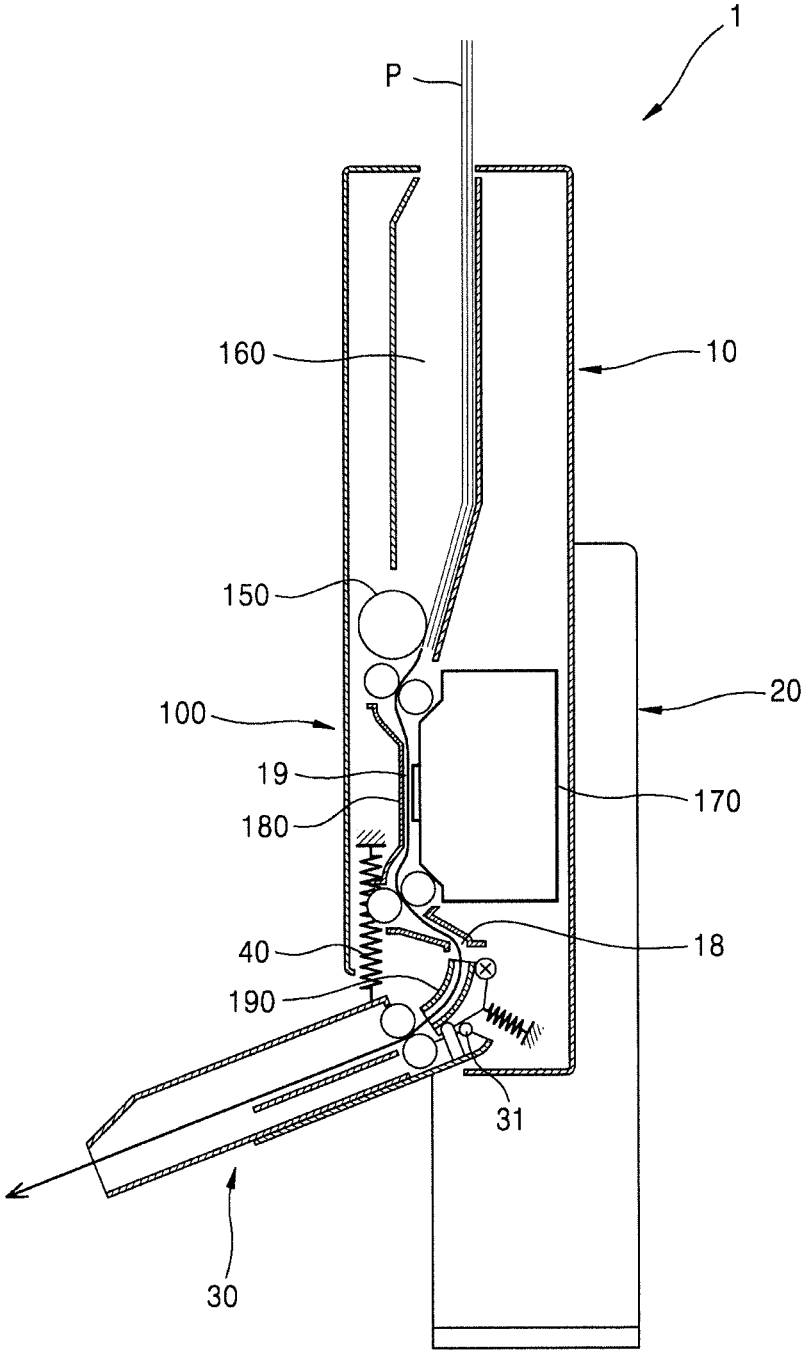
FIG. 3 is a longitudinal sectional view of an example of a printer in which a printing portion of an inkjet type is applied.

Although an example of the printing portion 100 of an electrophotographic type has been described, the printing portion 100 may print the image onto the print medium P in another printing manner. For example, the printing portion 100 may print the image onto the print medium P in various printing manners such as an inkjet manner, a thermal transfer manner, and the like. FIG. 3 is a longitudinal sectional view of an example of the printer 1 in which the printing portion 100 of an inkjet type is applied. Referring to FIG. 3, the printing portion 100 includes an inkjet cartridge 170. The inkjet cartridge 170 may include an inkjet head ejecting ink, and an ink tank accommodating the ink. The ink tank may be separated from the inkjet cartridge 170, and may be connected to the inkjet cartridge 170 by a connecting member such as a pipe or the like and thus supply the ink to the inkjet cartridge 170. The inkjet cartridge 170 may be a shuttle type inkjet cartridge ejecting the ink onto the print medium P that is moved in a sub-scanning direction while reciprocally moved in a main scanning direction. The inkjet cartridge 170 may be an array inkjet cartridge having a length which corresponds to a width of the print medium P in the main scanning direction, the array inkjet cartridge ejecting the ink onto the print medium P that is moved in the sub-scanning direction while being at fixed position without movement in the main scanning direction. Use of the array inkjet cartridge enables high-speed printing as compared with use of the shuttle type inkjet head. The inkjet cartridge 170 may be, for example, a monochrome inkjet cartridge ejecting ink of a black color. The inkjet cartridge 170 may be, for example, a color inkjet cartridge ejecting inks of black (K), yellow (Y), magenta (M), and cyan (C) colors. The inkjet cartridge 170 may be replaced once the end of the lifetime thereof has been reached.

The print medium P drawn from the loading portion 160 by a pickup roller 150 is transported along the vertically extending printing path 19, and is supported by a platen 180 to maintain a predetermined gap from the inkjet cartridge 170. The inkjet cartridge 170 ejects the ink onto the print medium P, thereby printing the image. The printing-completed print medium P is discharged through the outlet 18.

Referring to FIG. 1, the main body 10 has a width W, a height H, and a depth D. The depth D may be less than the width W. According to this configuration, a footprint of the printer 1 is less than a maximum printable size of the print medium P. Therefore, it is easy to put the printer 1, together with a monitor, on a desk, and user accessibility to the printer 1 may be secured. The depth D may be less than the height H.

Figure 4:
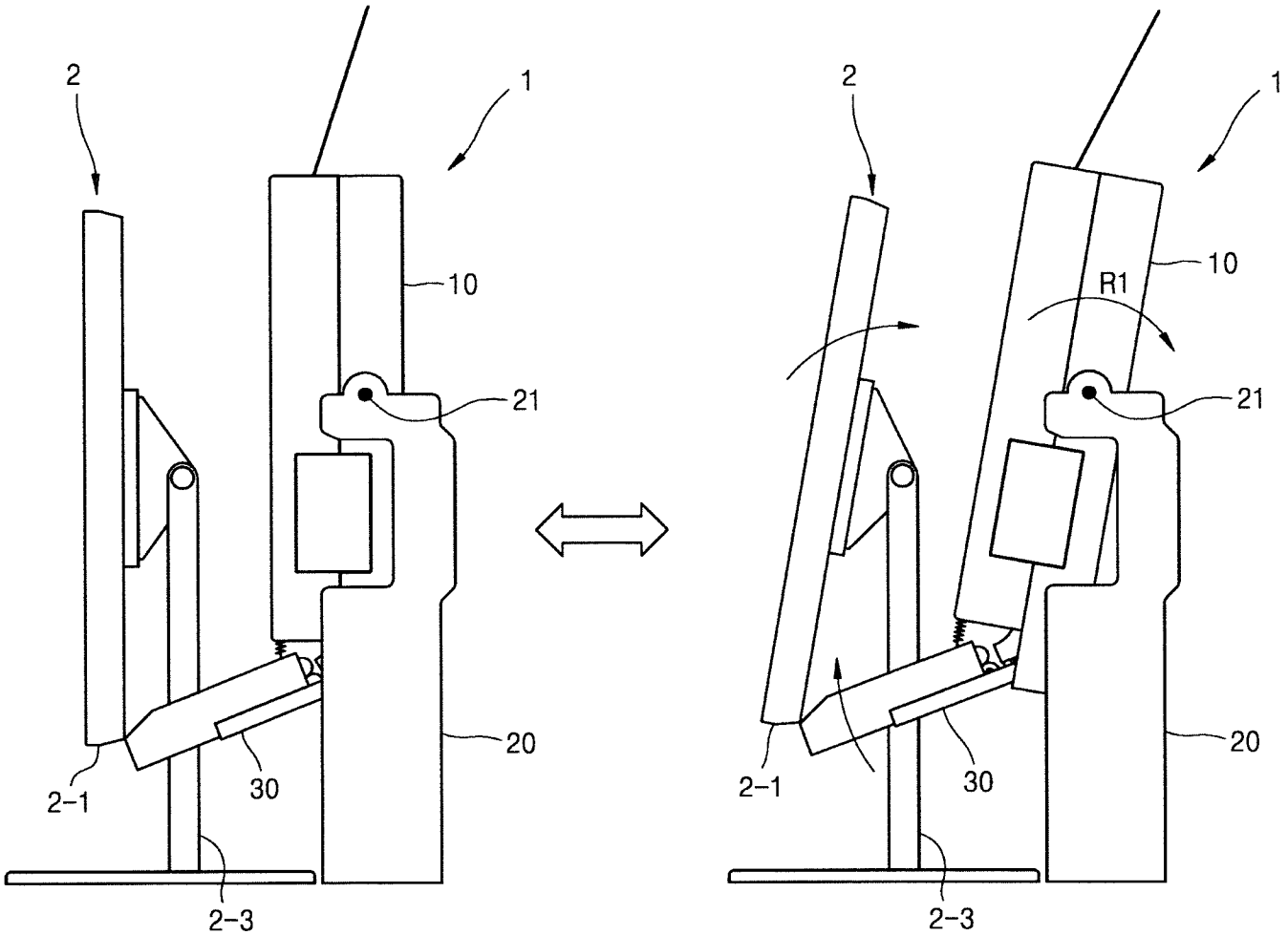
FIG. 4 is a side view illustrating an example of a printer used together with a monitor.

The printer 1 of the example may be useful when used together with a monitor. FIG. 4 is a side view illustrating an example of the printer 1 used together with a monitor. Referring to FIG. 4, the printer 1 is located behind a monitor 2. Here, the discharge guide 30 is maintained in contact with a lower edge 2-1 of the monitor 2 due to the elastic force of the first elastic member 40. The monitor 2 may be tilted backward by a user. Since the main body 10 is supported by the stand 20 to be rotatable in the front-rear direction R1, the main body 10 may also be tilted backward with respect to the stand 20 in accordance with a degree by which the monitor 2 is tilted. Here, since the discharge guide 30 is elastically biased to be rotated upward around a hinge 31 by the first elastic member 40, the discharge guide 30 may be maintained in contact with the lower edge 2-1 of the monitor 2. When the printing-completed print medium P is output from the printer 1, the print medium P seems to be output forward from the lower edge 2-1 of the monitor 2 from a viewpoint of a user in front of the monitor 2.

Such a structure may be useful to provide a special use experience to the user. For example, in the case where there is a request to print an electronic document, when the electronic document is printed by the printer 1 and output as an actual document, a user experience, in which a preview image of the electronic document requested to be printed disappears from a screen of the monitor 2 in synchronization with the output of the actual document by the printer 1, may be provided.

Figure 5:
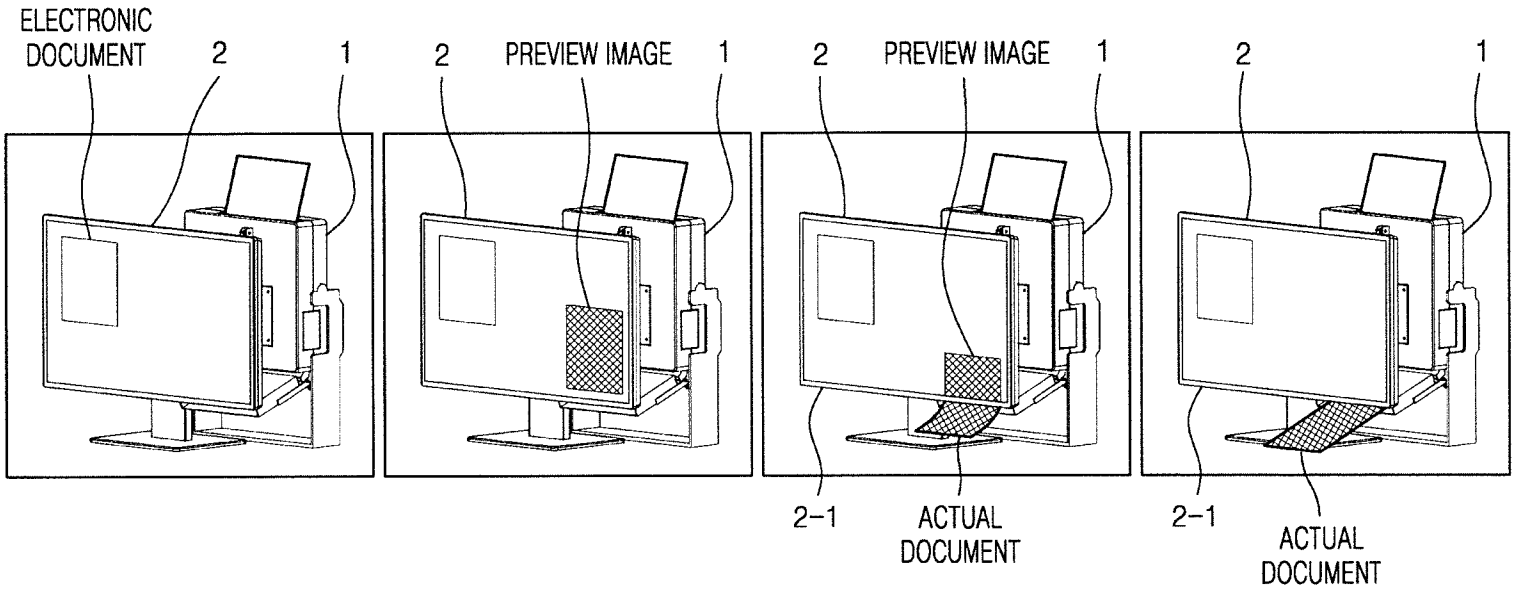
FIG. 5 is a diagram illustrating an example of a user experience in which a preview image of a document disappears from a screen of a monitor in synchronization with document output of a printer.

FIG. 5 is a diagram illustrating an example of a user experience in which a preview image of a document disappears from a screen of a monitor in synchronization with document output of a printer. Referring to FIG. 5, when a print command for the electronic document is issued to the printer 1 by a host, the preview image of the electronic document may be provided onto the screen of the monitor 2. When the actual document starts to be output from the printer 1, the preview image may also start to disappear from the screen of the monitor 2, and when the output of the actual document is completed, the preview image may also completely disappear from the screen of the monitor 2. A path along which the preview image is moved on the screen of the monitor 2 may overlap a path along which the actual document is output from the printer 1, and a sliding direction of the preview image may coincide with a direction in which the actual document is output starting from a lower end of the actual document. For example, as the preview image is moved, on the screen of the monitor 2, toward the lower edge 2-1, the preview image may gradually disappear from the screen. A process in which the preview image disappears toward the lower edge 2-1 of the monitor 2 may be synchronized with a process in which the printing-completed actual document is output from the printer 1. That is, a formation process of the preview image may be synchronized with a print process such that, when a lower edge of the preview image on the screen disappears to the lower edge 2-1 of the monitor 2, a leading end of the actual document output along the discharge guide 30 appears at the lower edge 2-1 of the monitor 2. According to this control, an effect by which the electronic document on the screen seems to come out as the actual document may be provided, thereby improving a user experience regarding the print process.

Referring again to FIG. 1, a door 15 that may be opened and closed may be provided to a side portion 14 of the main body 10 such that a consumable of the printing portion 100 may be replaced. According to this configuration, the door 15 for replacing the consumable may be arranged in the side portion 14 that is easily accessible in an environment in which the printer 1 is located behind the monitor 2, thereby improving user convenience. As an example, the door 15 may be rotatably provided to the side portion 14 of the main body 10. As an example, the door 15 may be separably combined with the side portion 14 of the main body 10. The consumable may be, for example, a development cartridge 110. The consumable may be, for example, an inkjet cartridge 170.

Figure 6:
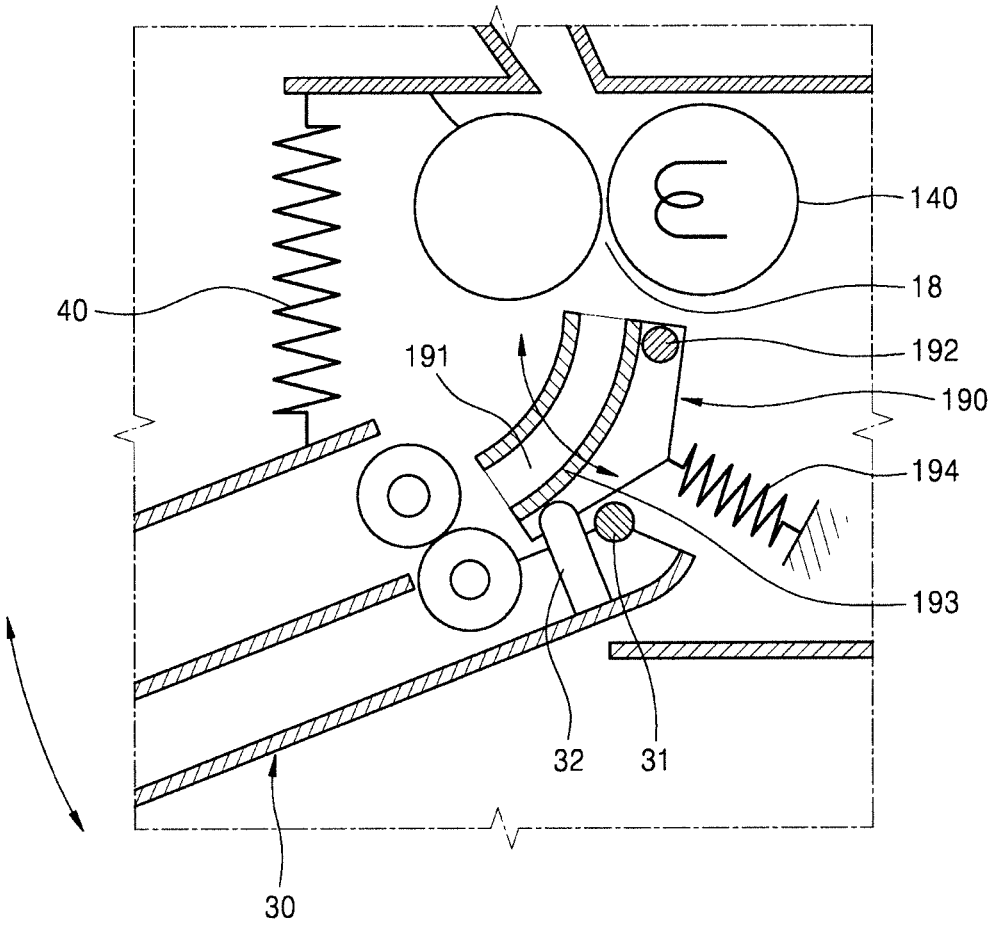
FIG. 6 is a detail view of a portion A of FIG. 2.

The printer 1 may have a structure stably guiding the print medium P, which is discharged through the outlet 18, to the discharge guide 30 as the discharge guide 30 is rotated in the vertical direction. FIG. 6 is a detail view of a portion A of FIG. 2. Referring to FIG. 6, a variable path member 190 is shown, the variable path member 190 forming a transport path 191 of the print medium P between the outlet 18 and the discharge guide 30 while being rotated in conjunction with the rotation of the discharge guide 30. The variable path member 190 is mounted in the main body 10 to be rotatable around a hinge 192. As an example of a structure for combining the rotation of the discharge guide 30 with the rotation of the variable path member 190, a first interfering portion 32 is provided to the discharge guide 30, and a second interfering portion 193 contacting the first interfering portion 32 is provided to the variable path member 190. A second elastic member 194 applies an elastic force to the variable path member 190 such that the second interfering portion 193 is rotated in a direction in which the second interfering portion 193 contacts the first interfering portion 32.

According to this configuration, when the discharge guide 30 is rotated upward around the hinge 31, the first interfering portion 32 pushes the second interfering portion 193, and thus, the variable path member 190 is rotated upward around the hinge 192. When the discharge guide 30 is rotated downward around the hinge 31, the variable path member 190 is rotated downward around the hinge 192 due to the elastic force of the second elastic member 194 such that the second interfering portion 193 is maintained in contact with the first interfering portion 32. Therefore, even though a tilt angle of the discharge guide 30 with respect to the main body 10 is changed, the print medium P discharged through the outlet 18 may be stably guided to the discharge guide 30 along the transport path 191 provided by the variable path member 190.

Figure 7:
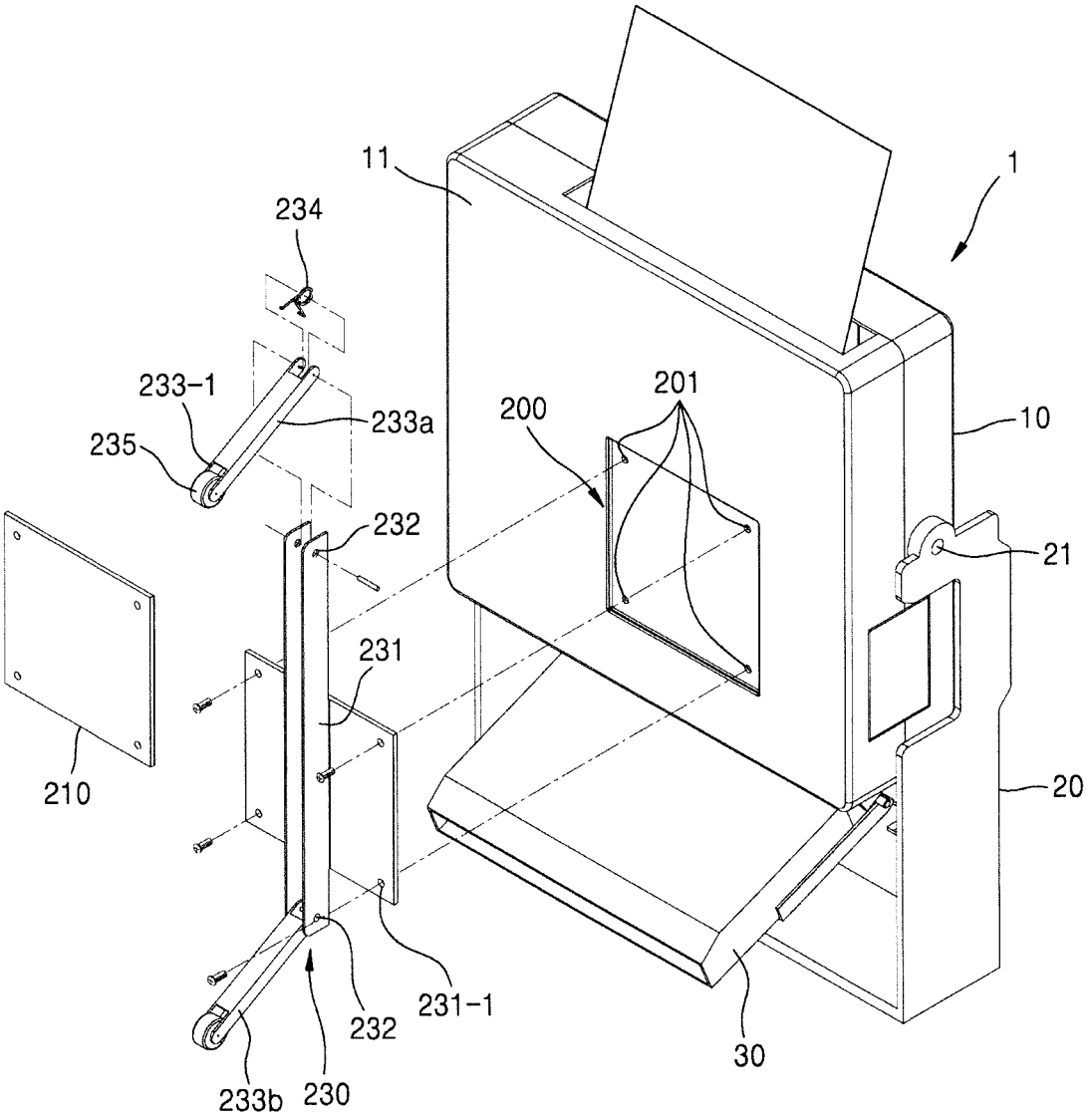
FIG. 7 is a partial exploded perspective view of an example of a printer.

The printer 1 may be rotated with respect to the stand 20 in conjunction with a change in a tilt angle of the monitor 2. FIG. 7 is a partial exploded perspective view of an example of the printer 1. Referring to FIG. 7, a first combining structure 200 is provided to the front portion 11 of the main body 10. The first combining structure 200 is a structure with which an external device may be combined. The first combining structure 200 may include, for example, one or more screw fastening portions 201 (screw holes). The number of screw fastening portions 201 and an interval therebetween are not limited. For example, the number of screw fastening portions 201 and the interval therebetween may comply with the VESA mount standards. According to this configuration, the external device satisfying the VESA mount standards may be directly combined with the first combining structure 200. In addition, the external device may be combined with the first combining structure 200 via an adaptor satisfying the VESA mount standards.

It may be optional to use the first combining structure 200. For this, the printer 1 may include a first cover 210 that is removable and covers the first combining structure 200 such that the first combining structure 200 is not exposed. The first cover 210 may be combined with the front portion 11 to cover the first combining structure 200. For example, the first cover 210 may be fixed to the front portion 11 such that the first cover 210 is combined with and thus covers the first combining structure 200. As another example, the first cover 210 may be fixed to the front portion 11 by a snap-fit structure to cover the first combining structure 200. According to this configuration, the first combining structure 200 may not be exposed outside thereof when not used, thereby improving appearance quality of the printer 1. After the first cover 210 is removed, the external device may be combined with the first combining structure 200.

In the printer 1 of the example, an interlocking member 230 is combined, as the external device, with the first combining structure 200 such that the main body 10 may be rotated with respect to the stand 20 in conjunction with the change in the tilt angle of the monitor 2 located in front of the printer 1. The interlocking member 230 may include: a bracket 231 having a structure combinable with the first combining structure 200; and at least one supporting arm protruding forward from the bracket 231 and elastically rotatable around a hinge 232 which is spaced apart from a rotation shaft 21 of the main body 10 in the vertical direction, that is, in a height direction. In the example, two supporting arms 233*a* and 233*b* are rotatably supported by the bracket 231. The two supporting arms 233*a* and 233*b* may be symmetrically located with reference to the rotation shaft 21 in the vertical direction, that is, in the height direction. A third elastic member 234 applies an elastic force to a supporting arm 233 such that the supporting arm 233 is rotated in a direction in which a leading end 233-1 of the supporting arm 233 faces forward. As an example, the third elastic member 234 may be a torsion coil spring including two arms respectively supported by the supporting arm 233 and the bracket 231. A roller 235 that is rotatable may be provided to the leading end 233-1 of the supporting arm 233. The bracket 231 may include, for example, mount holes 231-1 compliant with the VESA mount standards. By fastening screws to the screw fastening portions 201 of the first combining structure 200 through the mount holes 231-1, the bracket 231 may be combined with the first combining structure 200.

Figure 8:
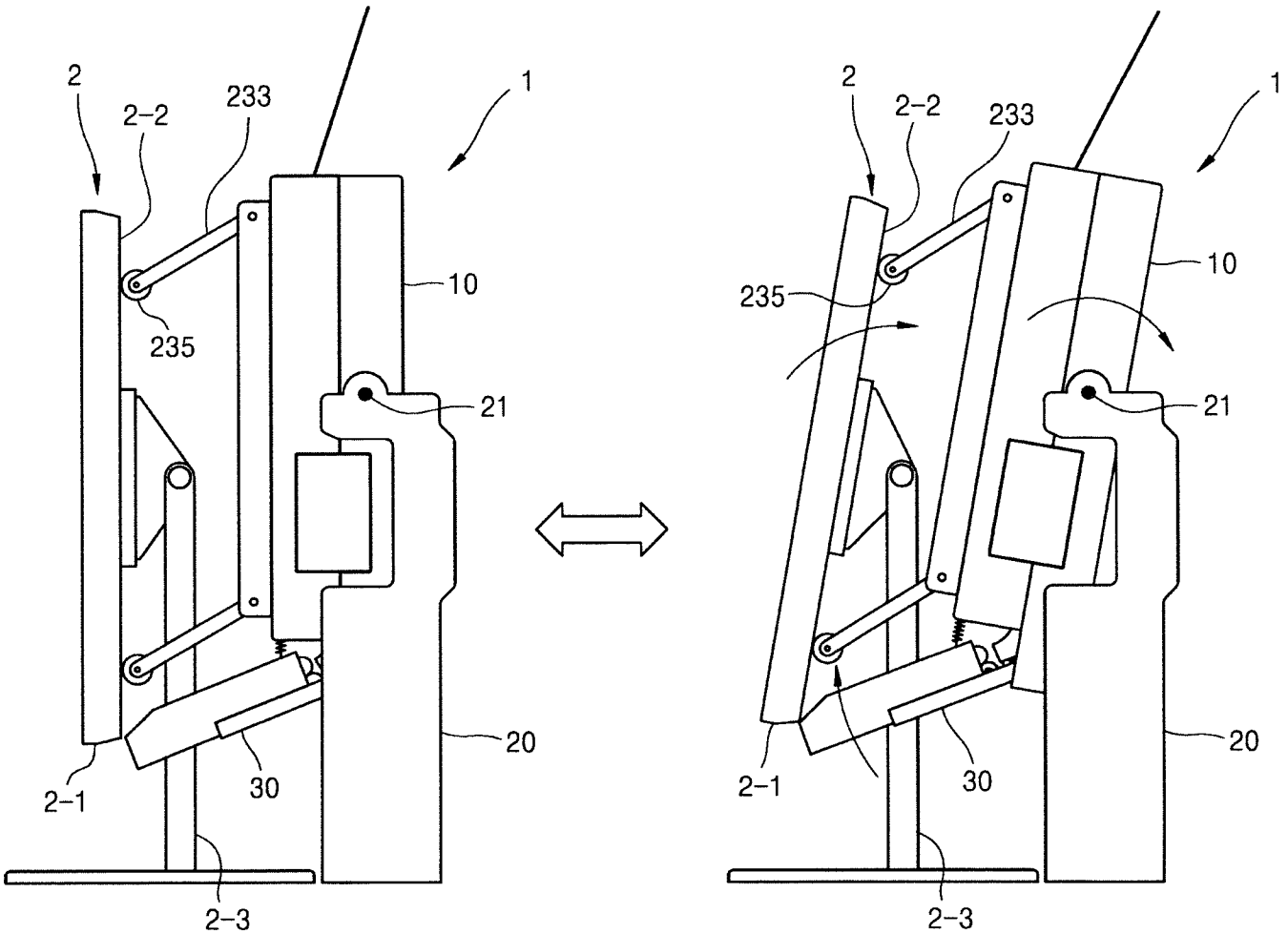
FIG. 8 is a side view illustrating that a main body is rotated in conjunction with a change in a tilt angle of a monitor.

FIG. 8 is a side view illustrating that the main body 10 is rotated in conjunction with the change in the tilt angle of the monitor 2. Referring to FIG. 8, the printer 1 is located behind the monitor 2. Here, the discharge guide 30 is maintained in contact with the lower edge 2-1 of the monitor 2 due to the elastic force of the first elastic member 40. The supporting arms 233*a* and 233*b* are maintained while the leading end 233-1 of each of the supporting arms 233*a* and 233*b* is in contact with a rear surface 2-2 of the monitor 2 due to the elastic force of the third elastic member 234. In the case where the roller 235 is provided, the roller 235 contacts the rear surface 2-2 of the monitor 2.

The monitor 2 may be tilted backward by a user. Then, the supporting arm 233*a* is pushed backward by the monitor 2, and the main body 10 is rotated backward around the rotation shaft 21 with respect to the stand 20. Here, the discharge guide 30 may be maintained in contact with the lower edge 2-1 of the monitor 2 due to the elastic force of the first elastic member 40. When the monitor 2 returns to an original state thereof, the supporting arm 233*b* is pushed backward by the monitor 2, and the main body 10 is rotated around the rotation shaft 21 with respect to the stand 20 and thus returns to an original state thereof. The supporting arms 233*a* and 233*b* may be maintained in contact with the rear surface 2-2 of the monitor 2 due to the elastic force of the third elastic member 234. In the case where the roller 235 that is rotatable is provided to the leading end 233-1 of each of the supporting arms 233*a* and 233*b*, since the rear surface 2-2 of the monitor 2 is in rolling contact with the roller 235, the main body 10 may be softly rotated in conjunction with the change in the tilt angle of the monitor 2.

As such, according to a structure in which the printer 1 has a tilt angle in conjunction with the tilt angle of the monitor 2, and in which the discharge guide 30 is maintained in contact with the lower edge 2-1 of the monitor 2, when the electronic document described with reference to FIG. 5 is printed by the printer 1 and output as the actual document, a user experience, in which the preview image of the electronic document requested to be printed disappears from the screen of the monitor 2 in synchronization with the output of the actual document by the printer 1, may be provided.

Figure 9:
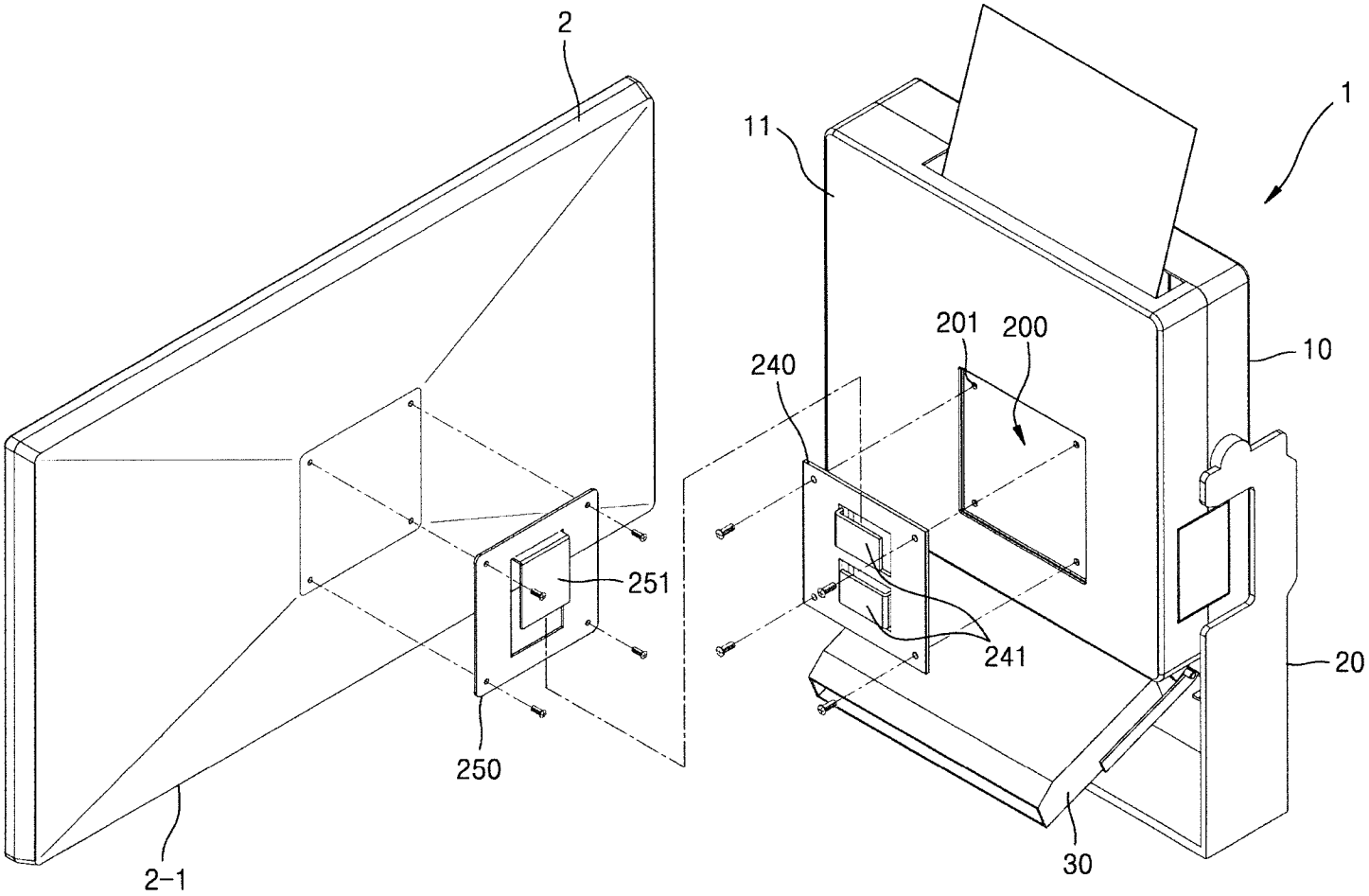
FIG. 9 is an exploded perspective view of an example of a monitor-integrated printer.

The external device may be the monitor 2. That is, the monitor 2 may be combined with the first combining structure 200. In this way, a monitor-integrated printer may be implemented. FIG. 9 is an exploded perspective view of an example of a monitor-integrated printer. Referring to FIG. 9, the first combining structure 200 is provided to the front portion 11 of the main body 10. The first combining structure 200 may be exposed, for example, by removing the first cover 210 (FIG. 7). The monitor 2 may be combined with the first combining structure 200.

In an example, the monitor 2 may be combined with the first combining structure 200 by an adaptor bracket. The adaptor bracket may include a first adaptor bracket 240, and a second adaptor bracket 250 that is combined with the monitor 2, for example, the rear surface 2-2 of the monitor 2. A first connecting portion 241 may be provided to the first adaptor bracket 240, and a second connecting portion 251 combined with the first connecting portion 241 in a male-female combining manner may be provided to the second adaptor bracket 250. The first connecting portion 241 may be detachably combined with the second connecting portion 251 in the vertical direction. As an example, the first connecting portion 241 may have a slot shape that is cut open in the vertical direction, and the second connecting portion 251 may have a clip shape that extends in the vertical direction to be insertable into the first connecting portion 241 of a slot shape in the vertical direction.

According to this configuration, since the stand 20 of the printer 1 may function as a stand 2-3 (FIG. 4) of the monitor 2, the stand 2-3 for the monitor 2 is not separately needed. When there is the stand 2-3 for the monitor 2, the printer 1 needs to be located at a position allowing no interference between the discharge guide 30 and the stand 2-3, that is, at a position biased toward one side in a width direction of the monitor 2 with respect to the stand 2-3. According to the example, since there is no interference between the print medium P output from the discharge guide 30 and the stand 2-3 of the monitor 2 due to the absence of the stand 2-3, the printer 1 may be mounted at various positions in the width direction of the monitor 2, for example, at a central position in the width direction of the monitor 2.

Since the monitor 2 is removable, the monitor 2 of various sizes may be combined with the printer 1, as needed. The discharge guide 30 may be naturally brought into contact with the lower edge 2-1 by the elastic force of the first elastic member 40 when the monitor 2 is combined with the main body 10. Therefore, when the electronic document described with reference to FIG. 5 is printed by the printer 1 and output as the actual document, a user experience, in which the preview image of the electronic document requested to be printed disappears from the screen of the monitor 2 in synchronization with the output of the actual document by the printer 1, may be provided.

In some cases, the printer 1 may be used as a stand-alone printer by removing the monitor 2 and combining the first cover 210 with the front portion 11.

Figure 10:
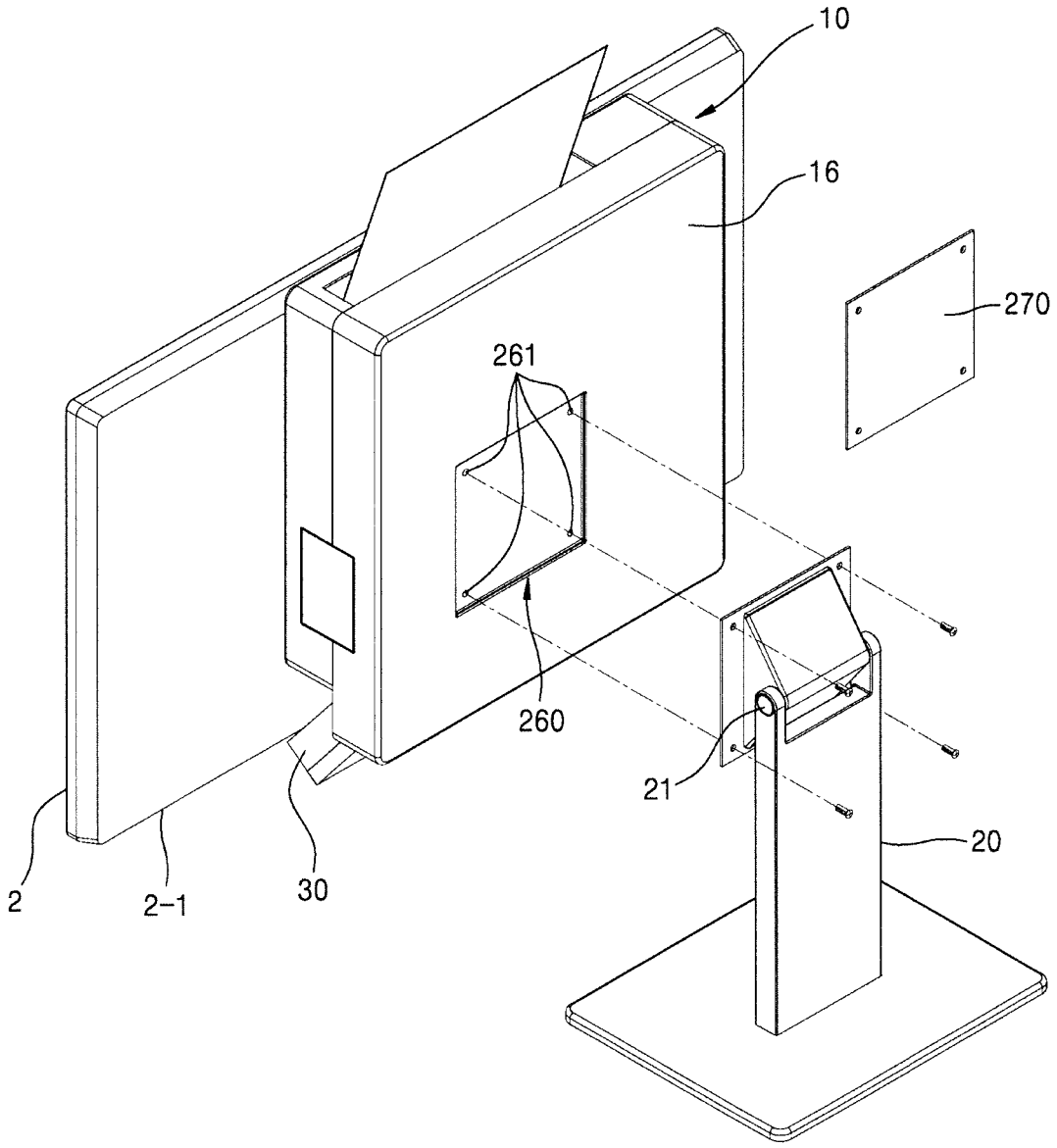
FIG. 10 is an exploded perspective view of an example of a monitor-integrated printer.

FIG. 10 is an exploded perspective view of an example of a monitor-integrated printer. Referring to FIG. 10, in the monitor-integrated printer in the example, the monitor 2 is combined with the front portion 11 of the main body 10, and the stand 20 is combined with a rear portion 16 of the main body 10.

The structure shown in FIG. 9 may be applied as a structure in which the monitor 2 is combined with the front portion 11 of the main body 10. In an example, the monitor 2 may be combined with the front portion 11 of the main body 10 by an adaptor bracket. The adaptor bracket may include: the first adaptor bracket 240 combined with the front portion 11 of the main body 10 and including the first connecting portion 241; and the second adaptor bracket 250 combined with the monitor 2 and including the second connecting portion 251 that is detachably combined with the first connecting portion 241. The first connecting portion 241 may be removably combined with the second connecting portion 251 in the vertical direction.

The stand 20 is combined with the rear portion 16 of the main body 10. The stand 20 includes the rotation shaft 21 supporting the main body 10 such that the main body 10 is rotatable in the front-rear direction. A second combining structure 260 may be provided to the rear portion 16 of the main body 10. The second combining structure 260 may include, for example, one or more screw fastening portions 261 (screw holes). The number of screw fastening portions 261 and an interval therebetween are not limited. For example, the number of screw fastening portions 261 and the interval therebetween may comply with the VESA mount standards. According to this configuration, the stand 20 satisfying the VESA mount standards may be directly combined with the second combining structure 260. In addition, the stand 20 may be combined with the second combining structure 260 via an adaptor satisfying the VESA mount standards.

It may be optional to use the second combining structure 260. For example, the stand 20 may be combined with the side portion 14 of the main body 10, as shown in FIG. 9. As such, when the second combining structure 260 is not used, the printer 1 may include a second cover 270 that is removable and covers the second combining structure 260 such that the second combining structure 260 is not exposed. The second cover 270 may be combined with the rear portion 16 to cover the second combining structure 260. For example, the second cover 270 may be fixed to the rear portion 16 such that the second cover 270 is combined with and thus covers the second combining structure 260. As another example, the second cover 270 may be fixed to the rear portion 16 by a snap-fit structure to cover the second combining structure 260. According to this configuration, the second combining structure 260 may not be exposed outside thereof when not used, thereby improving the appearance quality of the printer 1. After the second cover 270 is removed, the external device such as the stand 20 or the like may be combined with the second combining structure 260.

According to this configuration, since the stand 20 of the printer 1 may function as the stand 2-3 of the monitor 2, the separate stand 2-3 of the monitor 2 is not needed. When there is the stand 2-3 for the monitor 2, the printer 1 needs to be located at a position allowing no interference between the discharge guide 30 and the stand 2-3, that is, at a position biased toward one side in the width direction of the monitor 2 with respect to the stand 2-3. According to the example, since there is no interference between the print medium P output from the discharge guide 30 and the stand 2-3 of the monitor 2 due to the absence of the stand 2-3, the printer 1 may be mounted at various positions in the width direction of the monitor 2, for example, at a central position in the width direction of the monitor 2. Since the monitor 2 is removable, the monitor 2 of various sizes may be combined with the printer 1, as needed. The discharge guide 30 may be naturally brought into contact with the lower edge 2-1 by the elastic force of the first elastic member 40 when the monitor 2 is combined with the main body 10. Therefore, when the electronic document described with reference to FIG. 5 is printed by the printer 1 and output as the actual document, a user experience, in which the preview image of the electronic document requested to be printed disappears from the screen of the monitor 2 in synchronization with the output of the actual document by the printer 1, may be provided. In some cases, the monitor 2 may be removed, and the first cover 210 may be combined with the front portion 11. In addition, since the stand 20 is mounted to the rear portion 16 of the main body 10, it is easy to mount the door 15 for replacing the consumable to the side portion 14 of the main body 10.

While examples have been described with reference to the drawings, it will be understood that these are examples, and that various changes and equivalent examples may be made therefrom without departing from the spirit and scope as defined by the following claims. Therefore, the scope of the disclosure should be defined by the accompanying claims.

What is claimed is:

1. A printer, comprising:

a main body, having a width, a height, and a depth, to accommodate a printing portion that prints an image onto a print medium transported along a vertically oriented printing path, the main body including an outlet through which the print medium is discharged, and the depth being less than the width;

a stand to support the main body such that the main body is rotatable forward and backward;

a discharge guide, mounted to the main body to be rotatable in a vertical direction, to guide the print medium discharged from the outlet; and an elastic member to apply an elastic force to the discharge guide in an upward direction.

2. The printer according to claim 1, comprising:

a variable path member to form a transport path of the print medium between the outlet and the discharge guide while being rotated in conjunction with rotation of the discharge guide.

3. The printer according to claim 2, comprising:

a first interfering portion provided to the discharge guide;

a second interfering portion provided to the variable path member to contact the first interfering portion; and another elastic member to apply an elastic force to the variable path member such that the first interfering portion contacts the second interfering portion.

4. The printer according to claim 1, comprising:

a first combining structure provided to a front portion of the main body; and a first cover removably combinable with the front portion to cover the first combining structure.

5. The printer according to claim 4, comprising:

a bracket combinable with the first combining structure; and a supporting arm to protrude forward from the bracket and elastically rotatable around a hinge which is spaced apart from a rotation shaft of the main body in the vertical direction.

6. The printer according to claim 5, wherein a rotatable roller is combined with a leading end of the supporting arm.

7. The printer according to claim 4, comprising:

a monitor combinable with the first combining structure.

8. The printer according to claim 7, comprising:

an adaptor bracket to connect the first combining structure to the monitor.

9. The printer according to claim 7, comprising:

a second combining structure provided to a rear portion of the main body, wherein the stand is combinable with the second combining structure.

10. The printer according to claim 9, comprising:

a second cover removably combinable with the rear portion of the main body to cover the second combining structure.

11. The printer according to claim 1, wherein an openable and closeable door is provided at a side portion of the main body to allow a consumable of the printing portion to be accessed and replaced.

12. The printer according to claim 11, wherein the printing portion is to print the image onto the print medium in one of an electrophotographic manner or an inkjet manner, and the consumable includes one of a development cartridge or an inkjet cartridge.

13. The printer according to claim 1, comprising:

a monitor combinable with a front side of the printer such that when the monitor is tilted the printer is tilted at a same time and in a same direction as the monitor.

14. A printer, comprising:

a main body, having a width, a height, and a depth, to accommodate a printing portion that prints an image onto a print medium transported along a vertically oriented printing path, the main body including an outlet through which the print medium is discharged, and the depth being less than the width;

a stand combinable with a rear portion of the main body to support the main body such that the main body is rotatable forward and backward;

a monitor combinable with a front portion of the main body;

a discharge guide, mounted to the main body to be rotatable in a vertical direction, to guide the print medium discharged from the outlet; and an elastic member to apply an elastic force to the discharge guide in an upward direction.

15. The printer according to claim 14, comprising:

a first adaptor bracket combinable with the front portion of the main body and including a first connecting portion; and a second adaptor bracket combinable with a rear portion of the monitor and including a second connecting portion that is detachably combinable with the first connecting portion in the vertical direction.

* * * * *